US007398899B2

(12) United States Patent
Chang et al.

(10) Patent No.: US 7,398,899 B2
(45) **Date of Patent: *Jul. 15, 2008**

(54) CAULK DISPENSING DEVICE WITH SURE-GRIPS

(76) Inventors: Peter J. Chang, 11001 Petersborough Dr., Rockville, MD (US) 20852; Albert Lee, 5916 Perfect Calm Ct., Clarksville, MD (US) 21029

( * ) Notice: Subject to any disclaimer, the term of this patent is extended or adjusted under 35 U.S.C. 154(b) by 379 days.

This patent is subject to a terminal disclaimer.

(21) Appl. No.: 11/138,623

(22) Filed: May 26, 2005

(65) Prior Publication Data

US 2005/0263544 A1 Dec. 1, 2005

Related U.S. Application Data

(60) Provisional application No. 60/575,297, filed on May 28, 2004.

(51) Int. Cl.
*D67D 5/42* (2006.01)

(52) U.S. Cl. ..... 222/391; 16/430

(58) Field of Classification Search ..... 222/391; 16/422, 431, DIG. 12, 430; 74/551.9; D8/14.1
See application file for complete search history.

(56) References Cited

U.S. PATENT DOCUMENTS 2,520,808 A * 8/1950 Miller ..... 16/DIG. 12
4,875,386 A * 10/1989 Dickerson ..... 74/551.9
5,253,557 A 10/1993 Dolak
5,511,445 A 4/1996 Hildebrandt
5,579,848 A * 12/1996 Hsu ..... 16/422
D393,194 S 4/1998 Hogue et al.
6,155,354 A 12/2000 Pusateri et al.
6,270,134 B1 8/2001 Lin
6,454,138 B1 * 9/2002 Greenhill et al. ..... 222/391
D491,037 S * 6/2004 Chen ..... D8/107
D520,820 S * 5/2006 Chang et al. ..... D8/14.1

* cited by examiner

*Primary Examiner*—Lien T Ngo
(74) *Attorney, Agent, or Firm*—Ober/Kaler; Royal W. Craig

(57) ABSTRACT

A pair of sure-grip inserts formed as molded rubber sheathes for use in conjunction with a caulking gun having a downwardly protruding trigger that is retracted by hand to dispense caulk, and a downwardly protruding stationary handle to provide a hand grip for retracting the trigger. The trigger insert formed as an open-ended molded rubber sheath with a particular contoured shape and an internal channel conforming to the trigger for slidable insertion thereon. The handle insert is likewise formed as an open-ended molded rubber sheath conforming to the handle for slidable insertion thereon. The inserts are molded per a two-color double-injection-molding process to provide an aesthetically striking two-color appearance, and they are molded with a particular contoured design that conforms to the hand, thereby improving comfort during hard, extended use. The contour plus the use of soft-durometer thermoplastic rubber gives a high-coefficient of friction for a vastly improved grip under all (even wet) conditions.

14 Claims, 5 Drawing Sheets

CAULK DISPENSING DEVICE WITH SURE-GRIPS

CROSS-REFERENCE TO RELATED APPLICATIONS

The present application derives priority from U.S. Provisional Patent Application No. 60/575,297, filed: May 28, 2004.

FIELD OF THE INVENTION

The present invention relates to dispensing devices and, more particularly, to a hand-held caulk gun with improved trigger-grips for more effective ejection of caulk compound from a disposable cartridge.

BACKGROUND OF THE INVENTION

Conventional economy brand caulking guns are generally manual trigger-operated devices incorporating a unidirectional gripping assembly which urges a piston rod forward to eject the compound from a cartridge. One such prior art caulk gun is set forth in FIG. 1. This is a lightweight, skeleton-frame caulking gun designed to receive and carry a disposable caulk cartridge 20. The gripping assembly employs trigger-grip handles which are generally formed of stamped metal plate (as much of the rest of the gun) for manufacturing economy. The operator only has two hands; one holds the ladder and the other holds the caulking gun at the handle. The spread of the handles at the starting position can require a fairly broad grip, and a firm broad grip can be exceedingly difficult to achieve when the fingers and palm are only in contact with the painted or anodized metal trigger-grip handles. This is especially true when the user has smaller hands, as is often the case with female operators, during rainy or wet conditions, and in hot and sweaty conditions. Just a momentary slippage may result in a poor line of caulk and/or dropping the gun. When dropped from a scaffolding or ladder the potential for damage or injury is evident.

The trigger grips should be sure enough to keep the gun under as much control as possible under any kind of condition. This means that whether one's hand is wet or sweaty the trigger grips should not slip from one's grasp during use. The foregoing can be achieved by a better choice of grip materials. Some operators attempt to solve the problem in a do-it-yourself fashion by cutting a bicycle inner tube or rubber pads to fit the trigger grips, but this results in an aesthetically poor looking caulk gun with rubber handle elements that frequently slip off or come unbonded.

It would be far more advantageous to provide a caulking gun with sure-grip trigger handles that establish a good, non-slip, contoured gripping surface that conforms to the hand, thereby improving the grip even in wet conditions and improving comfort during hard, extended use. Others have devised rubberized handles in other context, such as bicycles (see U.S. Pat. No. 4,031,775). However, there are no known efforts to incorporate a rubber gripping feature in the context of a caulk gun trigger mechanism.

SUMMARY OF THE INVENTION

In accordance with the above, it is an object of the present invention to provide a formed metal caulking gun with sure-grip trigger handle inserts that provide a good, non-slip, surface even in wet conditions to avoid slippage and possible dropping of the gun.

It is another object to provide a caulking gun with sure-grip trigger handle inserts that are contoured to conform to the hand, thereby improving comfort during hard, extended use.

It is still another object to provide a caulking gun with trigger-handles adapted to secure and retain sure-grip trigger handle inserts thereon, without tendency for falling off.

It is yet another object to provide sure-grip trigger handle inserts of a two-color double-injection-molded design, thereby providing an aesthetically striking appearance.

The above and other objects and advantages of the invention will become more readily apparent on examination of the following description, including the drawings, in which like reference numerals refer to like parts. For the purpose of illustration, the sure-grip trigger handle inserts of the present invention are shown in the context of a half-barrel caulking gun of the type having a metal frame supporting a downwardly extending fixed handle, and a downwardly extending trigger which drives a plunger shaft that is slidably supported in the housing. A piston is mounted on the distal end of the plunger shaft and, when advanced through the frame and cartridge, dispenses caulking composition from the cartridge.

The improvement disclosed herein includes sure-grip inserts formed as molded rubber sheathes adapted for slidable insertion onto both the downwardly extending fixed handle and trigger-handle, and adaptations to both the fixed handle and trigger-handle to secure and retain the sure-grip inserts thereon without tendency for falling off. Otherwise, the caulking gun may be any conventional metal or plastic caulking gun of open frame, closed half-barrel, or other design.

The sure-grip inserts are formed as molded rubber sheathes in a two-color double-injection-molding process to provide an aesthetically striking two-color appearance. The sure-grip inserts are molded in a particular contoured design to conform to the hand, thereby improving comfort during hard, extended use. They and the adaptations to the fixed handle and trigger-handle are simple and inexpensive to manufacture, yet highly effective. Their simplicity allows them to be manufactured OEM or retrofit for minimal additional cost.

DETAILED DESCRIPTION OF THE PREFERRED EMBODIMENTS

Figure 1:
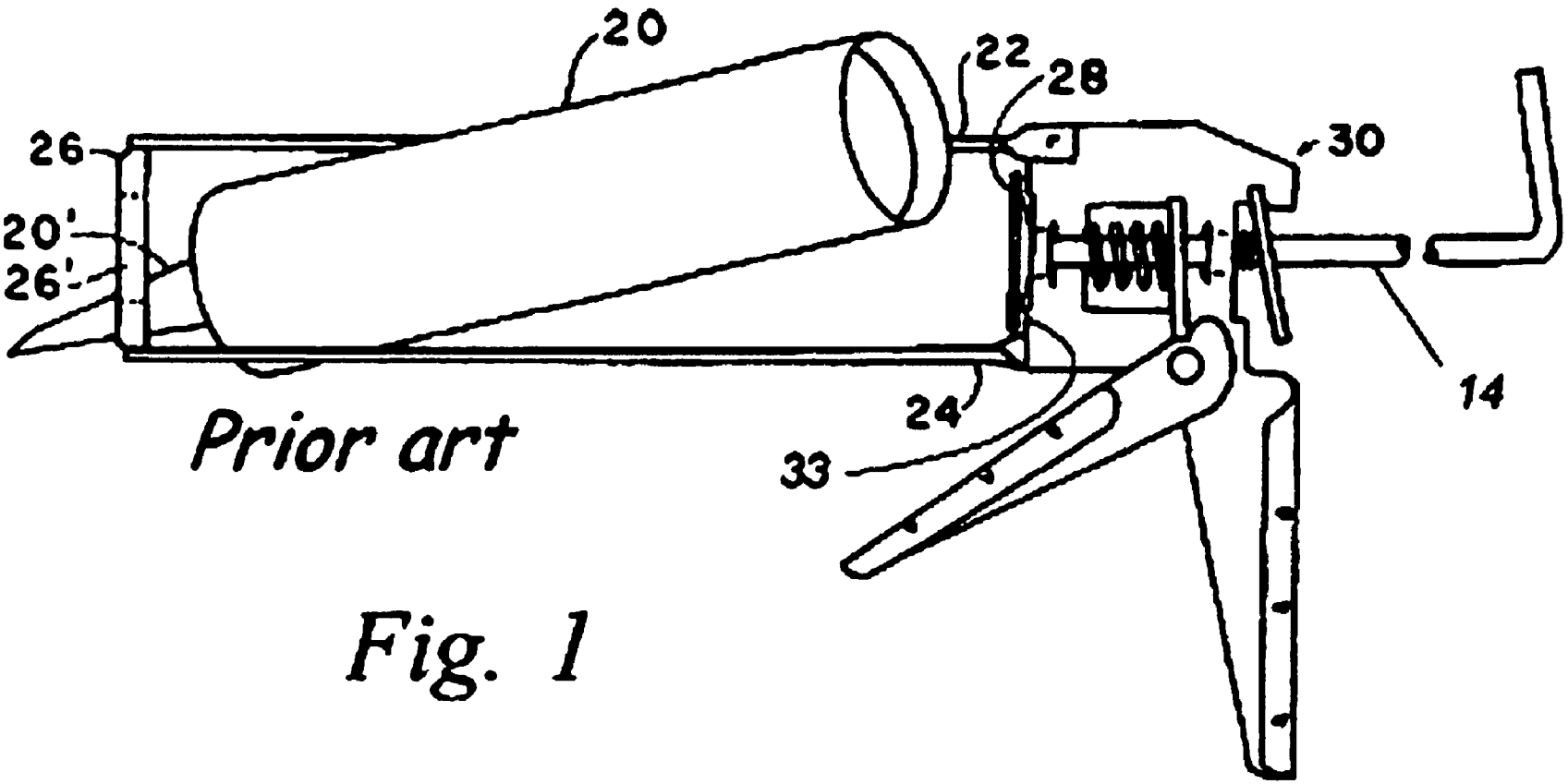
Prior art Fig. 1
FIG. 1 is a side elevational view of a prior art skeleton-frame gun of the type having a frame supporting a downwardly extending fixed formed-metal handle, and a downwardly extending formed metal trigger which drives a plunger shaft that is slidably supported in the housing.

FIG. 1 is a side elevational view of a prior art skeleton-frame caulking gun. This open-frame skeleton gun incorporates a forward frame with two opposing arms 22 and 24 extending between a supporting wall 33 and a forward support yoke 26. The illustrated frame is adapted for carrying a conventional replaceable caulk cartridge 20 which may be inserted in advance of supporting wall 33 with its nozzle cradled in support yoke 26. A piston 28 is mounted at the distal end of a plunger shaft 14. A thrust assembly internal to housing 30 effects forward operation of the plunger shaft 14 and piston 28. The thrust assembly is actuated by a trigger 40 that is retracted by hand to urge a grip forward. A stationary handle 42 protrudes downward from housing 30 to provide a hand grip for retracting the trigger 40. As the grip is biased forward it reaches a critical angle where it engages plunger shaft 14, and further retraction of the trigger 40 is converted into lateral movement of plunger drive shaft 14. The plunger drive shaft 14 urges piston 28 incrementally forward through cartridge 20 in order to expel its contents.

Figure 2:
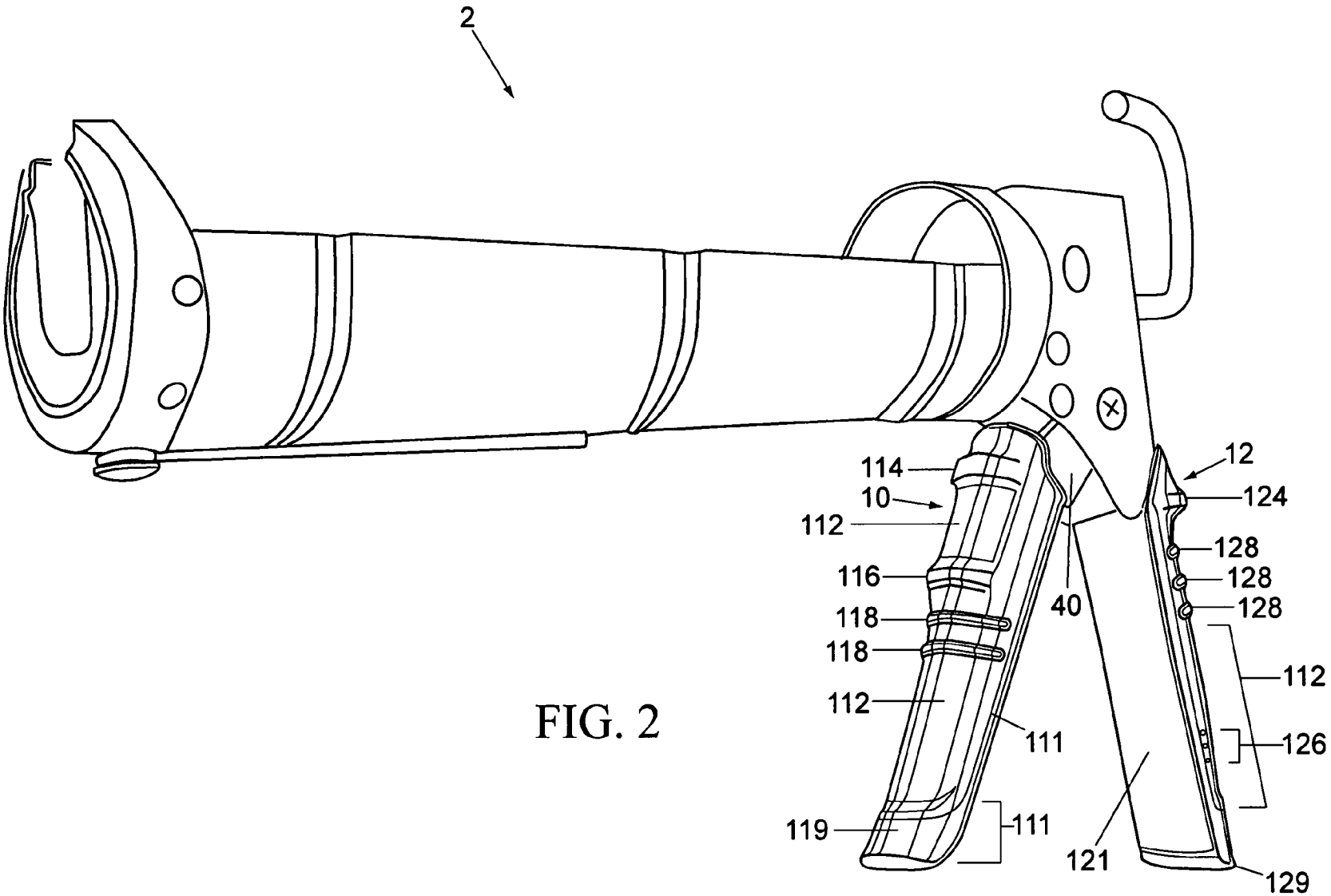
FIG. 2 is a side perspective view of a caulking gun 2 with sure-grip inserts according to the present invention inserted on both the downwardly extending fixed handle and pivoting trigger.

FIG. 2 is a side perspective view of a caulking gun 2 with sure-grip inserts 10, 12 according to the present invention inserted on the downwardly extending pivoting trigger 40 and fixed handle 42, respectively. The sure-grip trigger insert 10 is formed as a molded rubber sheath in a two-color double-injection-molding process to provide an aesthetically striking two-color appearance. This is accomplished in a known manner by an injection press having the ability to inject twice during the same cycle. In the illustrated embodiment, the first injection creates the underlying hard base section 111 (in one color, for example, blue). After a proper cooling time, the second injection will mold the upper soft gripping section 112 (in another color, for example, red) onto the hard base section 111. All of this is done during a single cycle and the finished trigger insert 10 is ejected at the end. Where a two-shot injection mold is not available the same result can be achieved by molding the hard base section 111 of the part first by itself. Later, during a second production run, the hard base section 111 would be placed in the mold by a machine operator as an insert to complete the molding of the upper soft gripping section 112. The sure-grip handle insert 12 is formed in the same manner to create an underlying hard base section 121 (again in one color such as blue). After a proper cooling time, the second injection will mold the upper soft gripping section 122 onto the hard base section 121.

The pivoting trigger 40 of the illustrated gun 2 is formed from a stamped metal plate having a rearwardly-open U-shaped cross-section. Similarly, the handle 42 is formed from a stamped metal plate having a forwardly-open U-shaped cross-section. Both sure-grip inserts 10, 12 are molded as elongate sheaths with a single open end leading into a U-shaped channel conforming to the U-shaped cross-sections of the respective trigger 40 and handle 42.

Both sure-grip inserts 10, 12 are preferably injection molded from thermoplastic rubber, which is non-marking, resistant to oils and chemicals, and offers a temperature range of −40 degrees F. to +180 F. Thermoplastic rubber pellets are available in a variety of durometers, and a soft durometer (approximately 40-70 A) is preferred for gripping. Both sure-grip inserts 10, 12 are externally molded in a particular contoured design to conform to the hand, thereby improving comfort during hard, extended use. Specifically, the trigger insert 10 is molded with two forwardly-directed spaced protruberances 114, 116 which define a recess for seating either the index or middle finger, as the user desires. A series of ribs 118 (two are here shown) are formed directly beneath the lower protruberance 116 to provide a more stable gripping surface for the pad of the next adjacent finger (the middle or fourth digit). Finally, a pronounced end butt 119 is formed both for impact resistance if the gun falls on the trigger 40, and to define a recessed area between the ribs 118 and butt 119 for seating all remaining fingers. The handle insert 12 is molded in a similar fashion with one rearwardly-directed protruberance 124 that abuts the palmar metacarpophalangeal joint of the hand. A series of ribs 128 (three are here shown) are formed directly beneath the protruberance 124 to provide a more stable gripping surface for the palm of the hand. Finally, a pronounced end butt 129 is formed both for impact resistance if the gun falls on the handle 42, and to define a recessed area between the ribs 128 and butt 129 for seating the palm of the hand.

In the preferred embodiment, a hole is formed leading straight up through the butts 119, 129 of both sure-grip inserts 10, 12 to allow drainage from within the hollows of the pivoting trigger 40 and handle 42. In addition, the injection molds may be altered to allow portions of the underlying hard base section 111 to show through the upper soft gripping section 112. This provides the capability of adding very pleasing aesthetic designs such as a series of dots 126 as shown which would appear as blue dots against a red background, thereby increasing the ornamental value of the inserts 10, 12.

Figure 3:
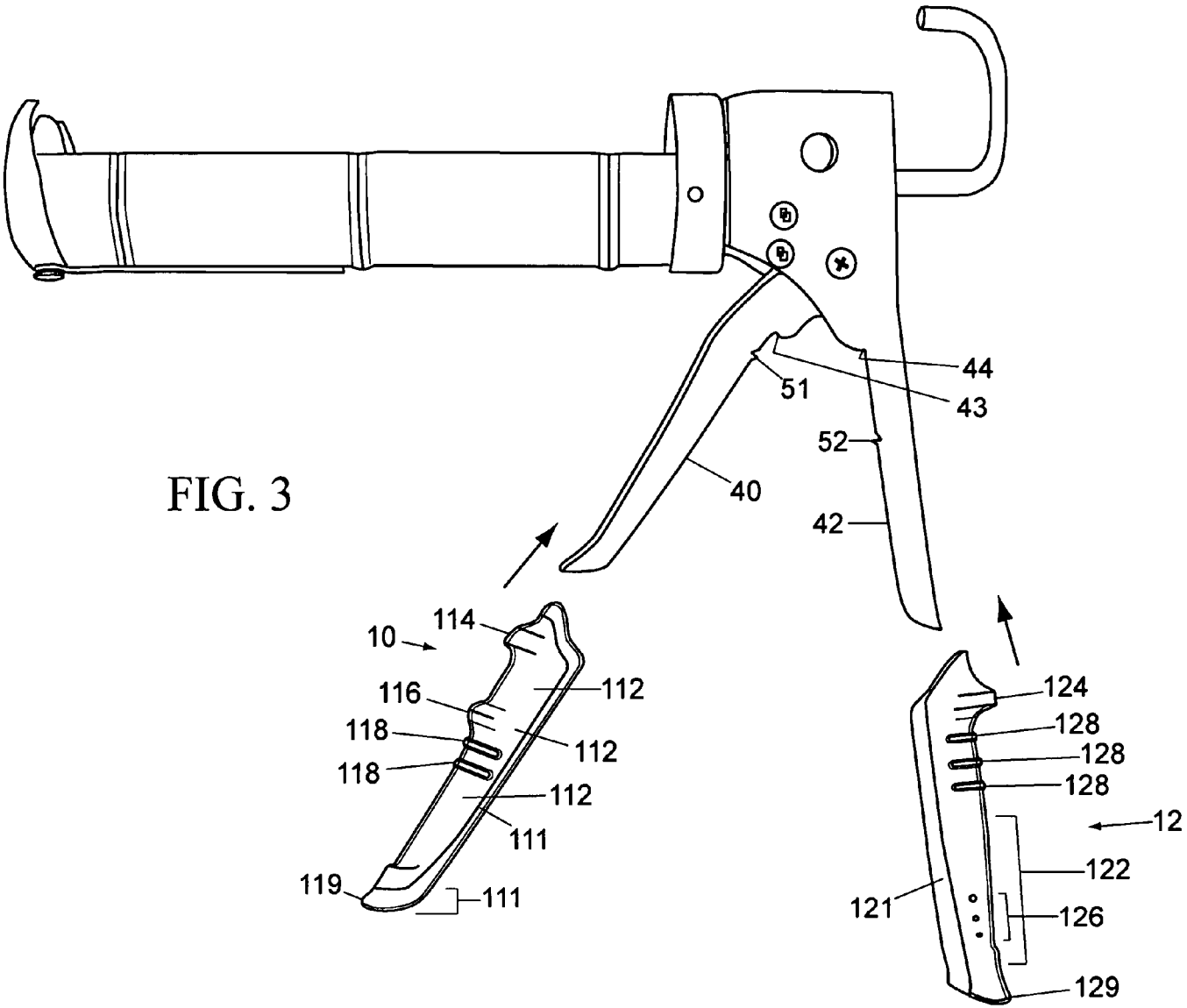
FIG. 3 is a side exploded view of caulking gun 2 with sure-grip inserts 10, 12 removed from the downwardly extending fixed handle 42 and pivoting trigger 40 to show the preferred modifications to the latter.

FIG. 3 is a side exploded view of caulking gun 2 with sure-grip inserts 10, 12 removed from the downwardly extending fixed handle 42 and pivoting trigger 40 to show the preferred modifications to the latter which ease assembly and which retain the sure-grip inserts 10, 12 thereon without tendency for falling off. As described above, both the handle 42 and trigger 40 are formed from stamped metal plates having an open U-shaped cross-section with parallel downwardly-leading edges. Both sure-grip inserts 10, 12 are molded as elongate sheaths with a conforming U-shaped channel conforming to the cross-sections of the respective trigger 40 and handle 42 to allow slidable insertion. In accordance with the present invention, both edges of both the trigger 40 and handle 42 are interrupted by flanges 43, 44, respectively, which limit insertion of the sure-grip inserts 10, 12, thereby demarcating full insertion and facilitating assembly. In addition, both edges of both the trigger 40 and handle 42 are defined by a series of notched teeth 51, 52, respectively. Each row of teeth 51, 52 preferably comprises at least two serrations which are recessed into the edges (cut into the plate rather than protruding), and with points inclined upwardly toward the flanges 43, 44 to resist downward slippage of the sure-grip inserts 10, 12. Since the sure-grip inserts 10, 12 are elastic and fit tightly over the trigger 40 and handle 42, the area along the edges of the trigger 40 and handle 42 beneath the flanges 43, 44 are pressure points against the sure-grip inserts 10, 12. This aids the teeth 51, 52 in biting into the rubber inserts 10, 12, which in turn prevents slipping off. On the other hand, the upward incline of the teeth 51, 52 allows free insertion without difficulty. These adaptations to the fixed handle 42 and trigger 40 are simple and inexpensive to manufacture, yet highly effective.

Figure 4:
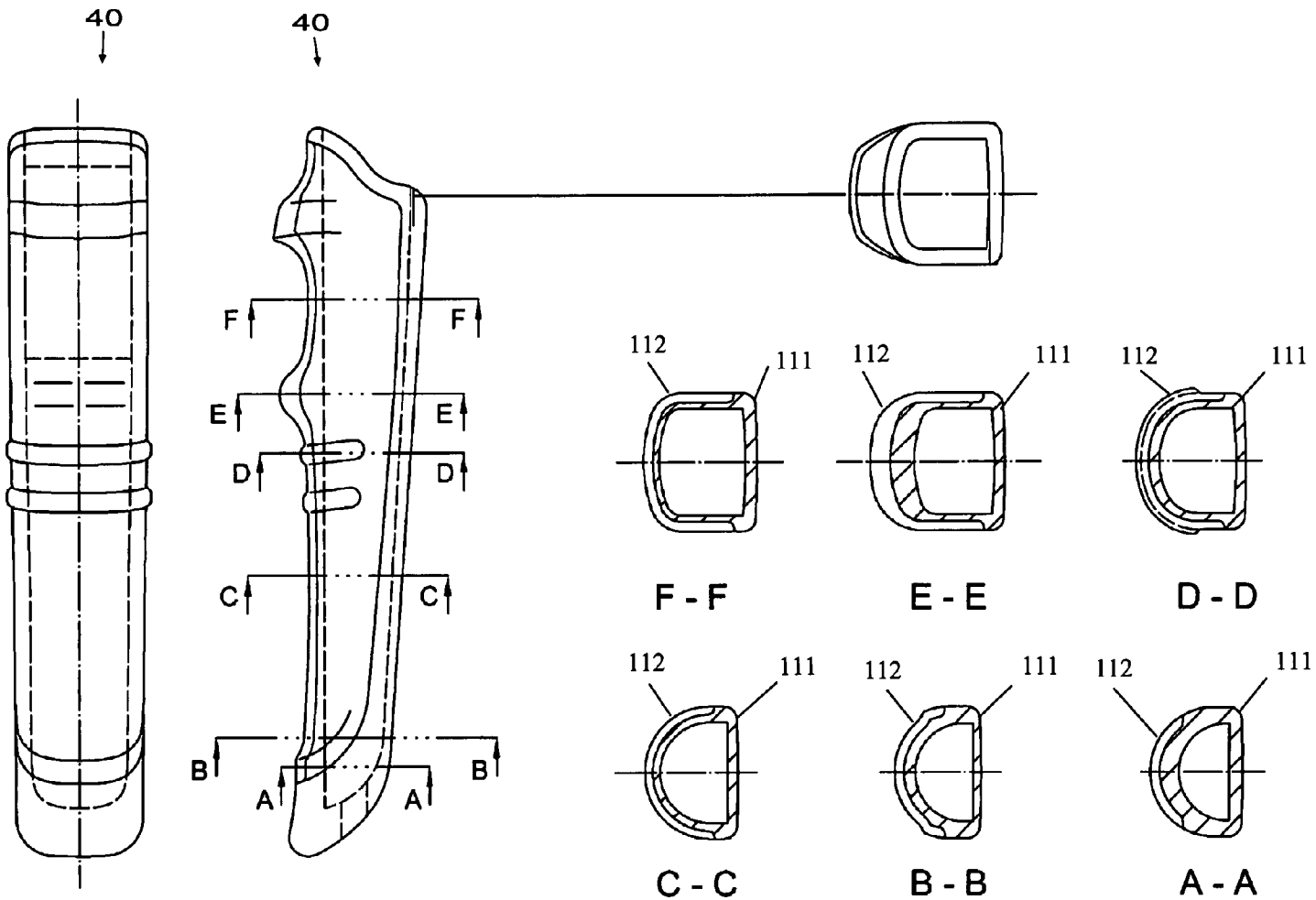
FIG. 4 is a composite drawing with front and side views of the trigger insert 40, and a plurality of cross-sections.

FIG. 4 is a composite drawing with front and side views of the trigger insert 40, and a plurality of cross-sections (along lines A-A, B-B, C-C, D-D, E-E, and F-F) to illustrate the mold variation lengthwise between the underlying hard base section 111 (blue), and the upper soft gripping section 112 (red).

Figure 5:
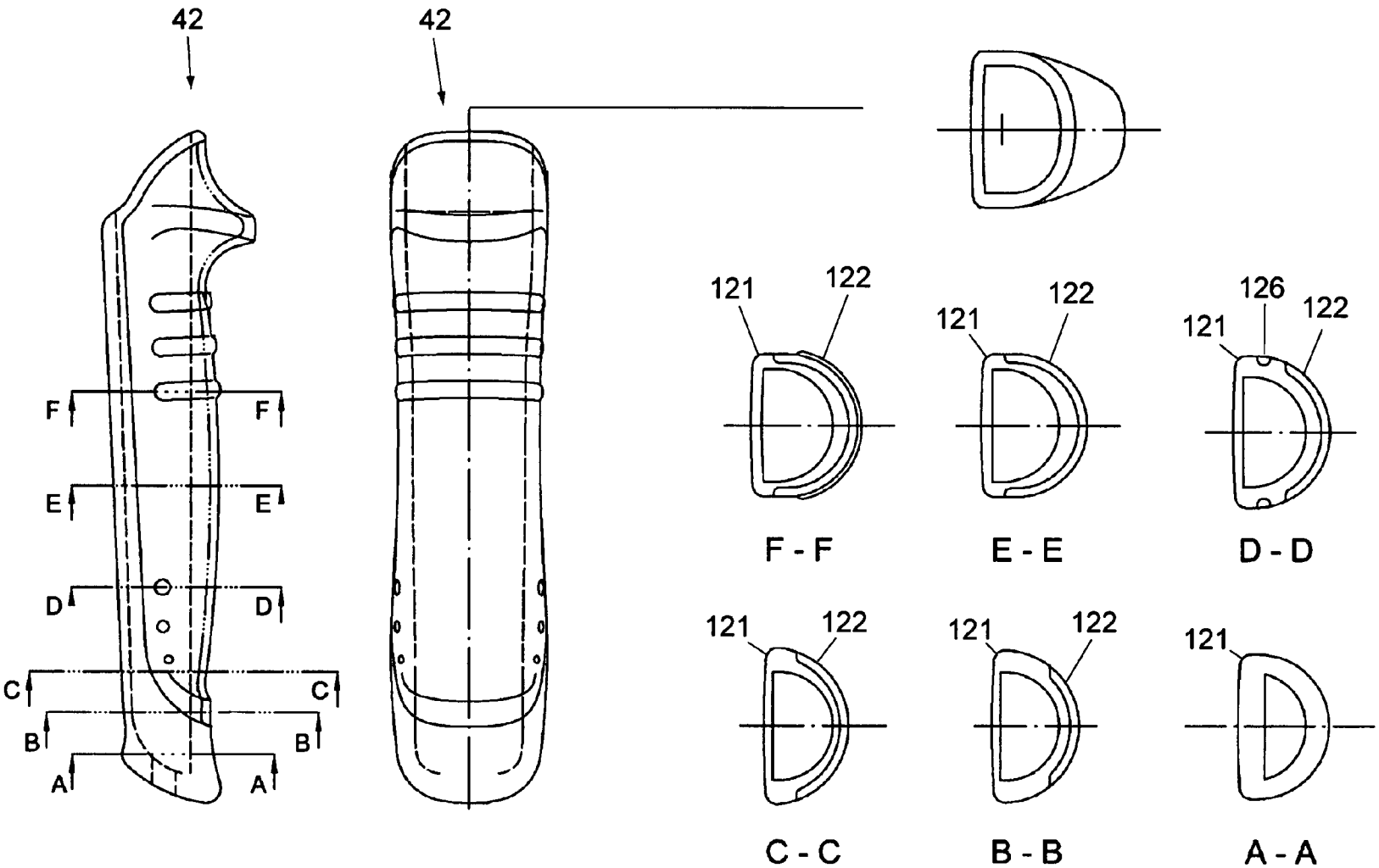
FIG. 5 is a composite drawing with front and side views of the handle insert 42, and a plurality of cross-sections.

FIG. 5 is a composite drawing with front and side views of the handle insert 42, and a plurality of cross-sections (along lines A-A, B-B, C-C, D-D, E-E, and F-F) to illustrate the mold variation lengthwise between the underlying hard base section 121 (blue), and the upper soft gripping section 122 (red).

The sure-grip inserts 40, 42 when formed as molded rubber sheathes in accordance with the profiles illustrated in FIGS. 4 and 5 per a two-color double-injection-molding process provide an aesthetically striking two-color appearance, and a particular contoured design that conforms to the hand, thereby improving comfort during hard, extended use. The use of soft-durometer thermoplastic rubber gives a high-coefficient of friction for a vastly improved grip under all (even wet) conditions.

Having now fully set forth a detailed example and certain modifications incorporating the concept underlying the present invention, various other modifications will obviously occur to those skilled in the art upon becoming familiar with said underlying concept. It is to be understood, therefore, that within the scope of the appended claims, the invention may be practiced otherwise than as specifically set forth herein.

The invention claimed is:

1. In a caulking gun having a downwardly protruding trigger that is retracted by hand to dispense caulk, and a downwardly protruding stationary handle to provide a hand grip for retracting the trigger, a pair of grip inserts further comprising:

a trigger insert formed as an open-ended molded rubber sheath conforming to said trigger for slidable insertion on said trigger, the trigger insert comprising:

two forwardly-directed spaced protruberances which define a recess for seating either the index finger or middle finger; and a series of ribs directly beneath one of said protruberances to provide a more stable gripping surface; and a handle insert formed as an open-ended molded rubber sheath conforming to said handle for slidable insertion on said handle.

2. The pair of grip inserts according to claim 1 wherein a first flange protrudes from the top of said trigger, and further wherein said trigger insert slidably inserts on said trigger up to said first flange whereby said first flange demarcates full insertion.

3. The pair of grip inserts according to claim 1 wherein a second flange protrudes from the top of said handle, and further wherein said handle insert slidably inserts on said handle up to said second flange whereby said second flange demarcates full insertion.

4. In a caulking gun having a downwardly protruding trigger that is retracted by hand to dispense caulk, and a downwardly protruding stationary handle to provide a hand grip for retracting the trigger, a pair of grip inserts further comprising:

a trigger insert formed as an open-ended molded rubber sheath conforming to said trigger for slidable insertion on said trigger; and a handle insert formed as an open-ended molded rubber sheath conforming to said handle for slidable insertion on said handle;

wherein a first flange protrudes from the top of said trigger, said trigger insert slidably inserts on said trigger up to said first flange whereby said first flange demarcates full insertion, a first edge of said trigger directly beneath said first flange comprises first notched teeth and said first notched teeth comprise at least two first serrations wherein said first serrations are recessed into said first edge, and said first edge bites into said trigger insert to resist downward slippage of said trigger insert.

5. In a caulking gun having a downwardly protruding trigger that is retracted by hand to dispense caulk, and a downwardly protruding stationary handle to provide a hand grip for retracting the trigger, a pair of grip inserts further comprising:

a trigger insert formed as an open-ended molded rubber sheath conforming to said trigger for slidable insertion on said trigger; and a handle insert formed as an open-ended molded rubber sheath conforming to said handle for slidable insertion on said handle;

wherein a second flange protrudes from the top of said handle, said handle insert slidably inserts on said handle up to said second flange whereby said second flange demarcates full insertion; a second edge of said handle directly beneath said second flange comprises second notched teeth and said second notched teeth comprise at least two second serrations wherein said second serrations are recessed into said second edge, and said second edge bites into said handle insert to resist downward slippage of said handle insert.

6. The pair of grip inserts according to claim 1, wherein said trigger insert and said handle insert are injection molded from polypropylene thermoplastic rubber.

7. The pair of grip inserts according to claim 6, wherein said trigger insert and said handle insert are injection molded from polypropylene thermoplastic rubber in a two-color injection-molding process to provide an aesthetically striking two-color appearance.

8. The pair of grip inserts according to claim 7, wherein said two-color injection-molding process comprises the steps of:

a first injection molding an underlying hard base section in one color; a cooling of said underlying hard base section;

a second injection molding an upper soft gripping section in another color onto said hard base section; and ejecting said trigger insert and said handle insert.

9. The pair of grip inserts according to claim 8, wherein underlying hard base section shows through said upper soft gripping section providing a series of dots which appear as said one color against said second color.

10. The pair of grip inserts according to claim 1, wherein said trigger insert is molded with a first pronounced end butt directly beneath said series of ribs to provide impact resistance and to define a recessed area between said ribs and said butt for seating all remaining fingers.

11. The pair of grip inserts according to claim 1, wherein said handle insert is molded with one rearwardly-directed spaced protruberance that abuts the palmar metacarpophalangeal joint of the hand.

12. The pair of grip inserts according to claim 11, wherein said handle insert is molded with a series of ribs directly beneath said protruberance to provide a more stable gripping surface.

13. The pair of grip inserts according to claim 12, wherein said handle insert is molded with a second pronounced end butt directly beneath said series of ribs to provide impact resistance and to define a recessed area between said ribs and said butt for seating the palm of the hand.

14. The pair of grip inserts according to claim 13, wherein a second hole is formed through said second pronounced end butt to allow drainage within said handle.

* * * * *